US008413879B2

(12) United States Patent
Bevier

(10) Patent No.: US 8,413,879 B2
(45) **Date of Patent: *Apr. 9, 2013**

(54) DRAWER FRONT CONTAINER AND ASSOCIATED CONTAINER BLANK

(75) Inventor: Alex D Bevier, Naches, WA (US)

(73) Assignee: International Paper Company, Memphis, TN (US)

( * ) Notice: Subject to any disclaimer, the term of this patent is extended or adjusted under 35 U.S.C. 154(b) by 522 days.

This patent is subject to a terminal disclaimer.

(21) Appl. No.: 12/171,683

(22) Filed: Jul. 11, 2008

(65) Prior Publication Data

US 2010/0006569 A1 Jan. 14, 2010

(51) Int. Cl.
*B65D 25/00* (2006.01)

(52) U.S. Cl.
USPC ..... 229/122; 220/62; 206/45.21

(58) Field of Classification Search ..... 206/45.2, 206/45.21; 229/123
See application file for complete search history.

(56) References Cited

U.S. PATENT DOCUMENTS

| | | | | |
|---|---|---|---|---|
| 1,114,042 | A * | 10/1914 | Richardson | 229/121 |
| 3,568,911 | A * | 3/1971 | Bebout | 206/738 |
| 6,951,300 | B2 * | 10/2005 | Caille et al. | 229/121 |
| 7,066,380 | B2 * | 6/2006 | Blake | 229/122.1 |
| 7,204,406 | B2 * | 4/2007 | Bone | 229/242 |
| 7,367,490 | B2 * | 5/2008 | Forthaus et al. | 229/117.24 |
| 2002/0109004 | A1 * | 8/2002 | Barr et al. | 229/117.14 |
| 2006/0289616 | A1 * | 12/2006 | McGowan | 229/122.1 |
| 2010/0006456 | A1 * | 1/2010 | Bevier | 206/45.21 |

* cited by examiner

*Primary Examiner* — Nathan J Newhouse
*Assistant Examiner* — Christopher Demeree
(74) *Attorney, Agent, or Firm* — Matthew M. Eslami

(57) ABSTRACT

A single piece blank and resulting container having an operable tray panel for easily viewing and accessing products contained within is disclosed. Specifically, the container is designed to have an operable tray panel in an upper portion of the container. The operable tray panel allows easy access to products in the container. Further, it provides better viewing of contents such that the urge to access the contents is increased via the increased visibility. The structure provides a strong and stable container that may be constructed to varying sizes and geometries.

2 Claims, 4 Drawing Sheets

DRAWER FRONT CONTAINER AND ASSOCIATED CONTAINER BLANK

FIELD OF THE INVENTION

This invention relates generally to single piece container blanks and their resulting containers. More specifically, the present invention relates to a storage and display container having a pivotable tray opening for easy access to and visibility of contents contained within.

BRIEF DESCRIPTION OF THE DRAWINGS

The invention is best understood from the following detailed description when read in connection with accompanying drawings. It is emphasized that, according to common practice, various features of the drawings are not to scale. On the contrary, the dimensions of various features are arbitrarily expanded or reduced for clarity. Included in these drawings are the following figures.

DETAILED DESCRIPTION

The present invention will now be described with reference to the accompanying drawings. The present invention is directed to a single piece blank 20 used to form a container 44. The design allows for easy access to and viewing of contents contained within the container 44. One suitable embodiment of the blank 20 and resulting container 44 is described in more particularity below.

Figure 1:
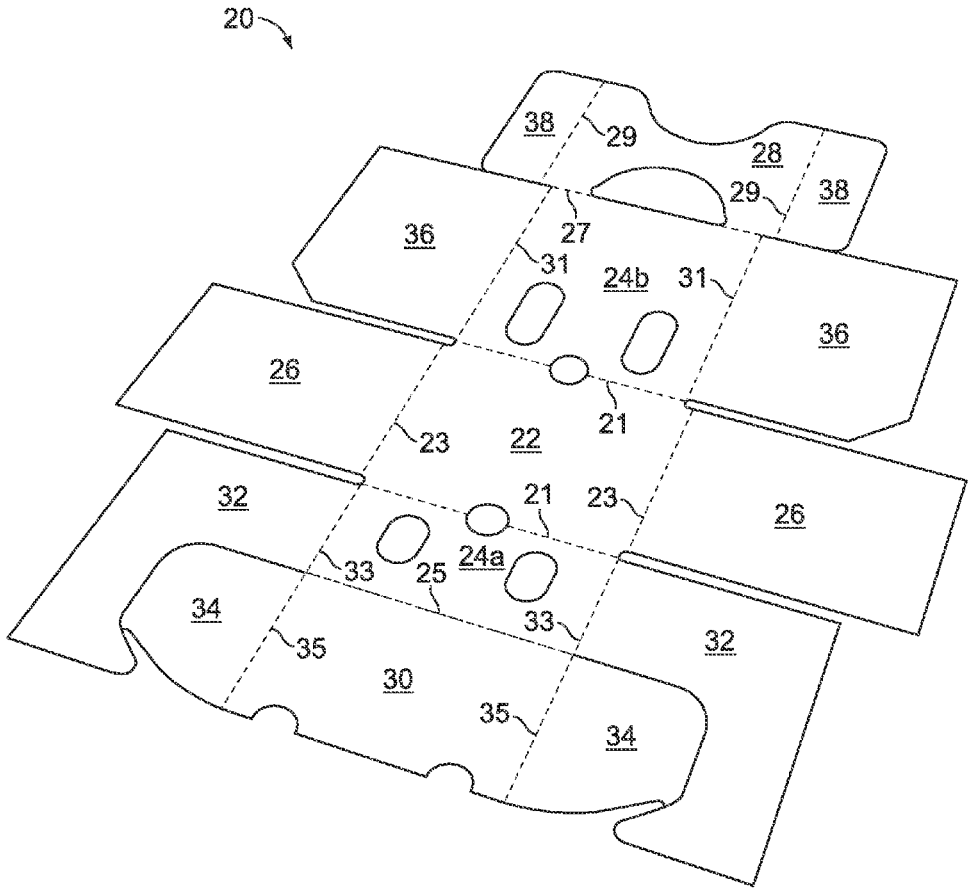
FIG. 1 is a perspective view of an exemplary blank arrangement.

FIG. 1 depicts a blank 20 used to form a container 44. The blank 20 is typically constructed from a single piece of formable material such as, without limitation, sheets of cellulose-based material formed from cellulose materials such as wood pulp, straw, cotton, bagasse, or the like. Cellulose-based materials used in the present invention may come in many forms, such as fiberboard, containerboard, corrugated containerboard and paperboard. However, it will be appreciated that the single piece of formable material may be constructed from other material as well, such as, without limitation, a polymer based material. The polymer based material may be in the form of a sheet of plastic material, or a sheet of corrugated plastic material.

The blank 20 is cut and scored, perforated or otherwise formed into a plurality of panels that, when assembled, form container 44. In all FIGURES, like numbers indicate like parts; additionally, cut lines are shown as solid lines, score lines as dashed lines, and lines of perforation as broken lines. For the purposes of further description herein, the downward direction is defined as a direction perpendicular to the first bottom panel 22 when the container 44 has been erected. The upwards direction is defined as the direction perpendicular to the first bottom panel 22 that corresponds to the inner surface of the bottom panel when the container 44 has been erected.

With respect to FIG. 1, the blank 20 includes a bottom panel 22 bounded by fold lines 21 and 23. Attached to the bottom panel 22 along fold lines 23 are second side panels 26. Attached to the bottom panel 22 along the fold lines 21 are first side panels 24. Connected with one of the first side panels

24, opposite fold line 21, is a tray panel 30. Further connected to the first side panel 24, along fold lines 33, are third side panels 32. Connected with tray panel 30, along fold lines 35, are tray panel flaps 34. Connected with the other first side panel 24, along fold lines 31, are fourth side panels 36. Further, top panel 28 is connected with this other first side panel 24 along fold line 27. The top panel 28 is also connected with top panel flaps 38 along fold lines 29.

Figure 2:
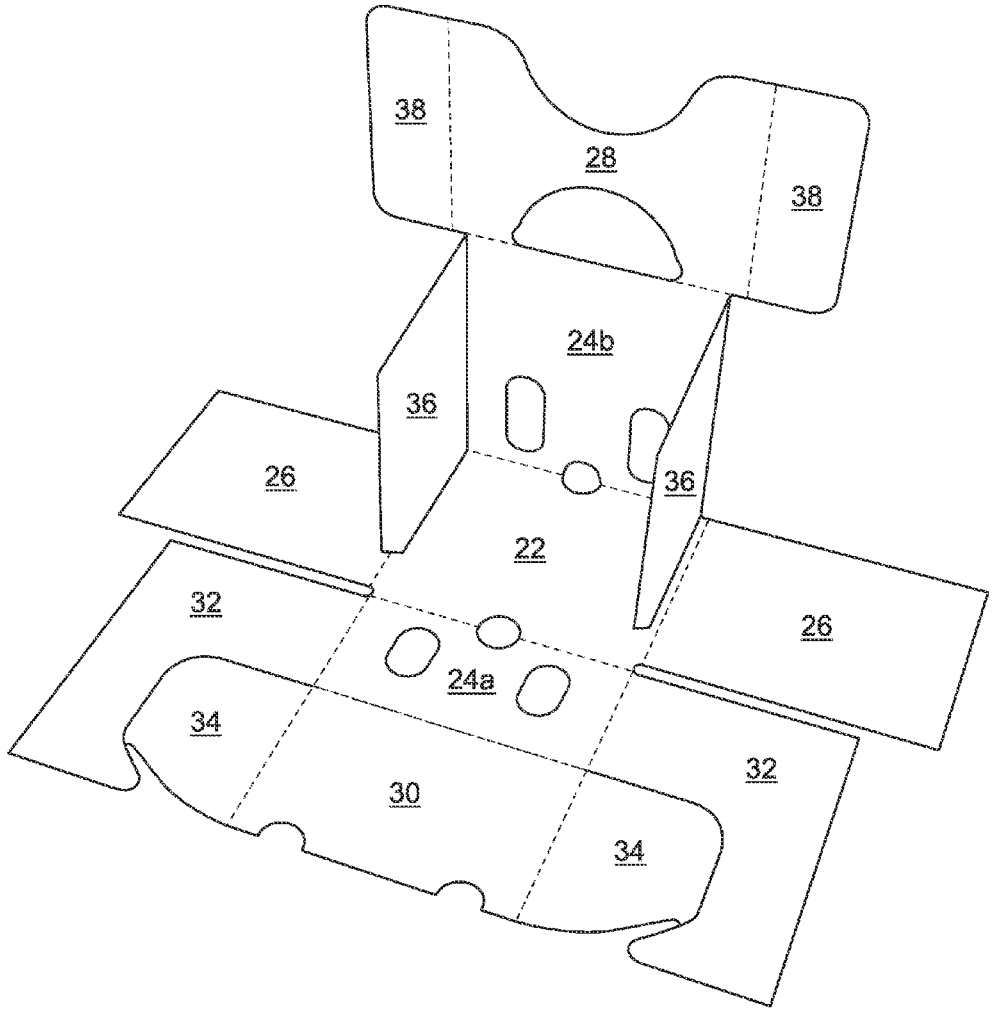
FIG. 2 is an exemplary partially erected view of the blank arrangement of FIG. 1.
Figure 3:
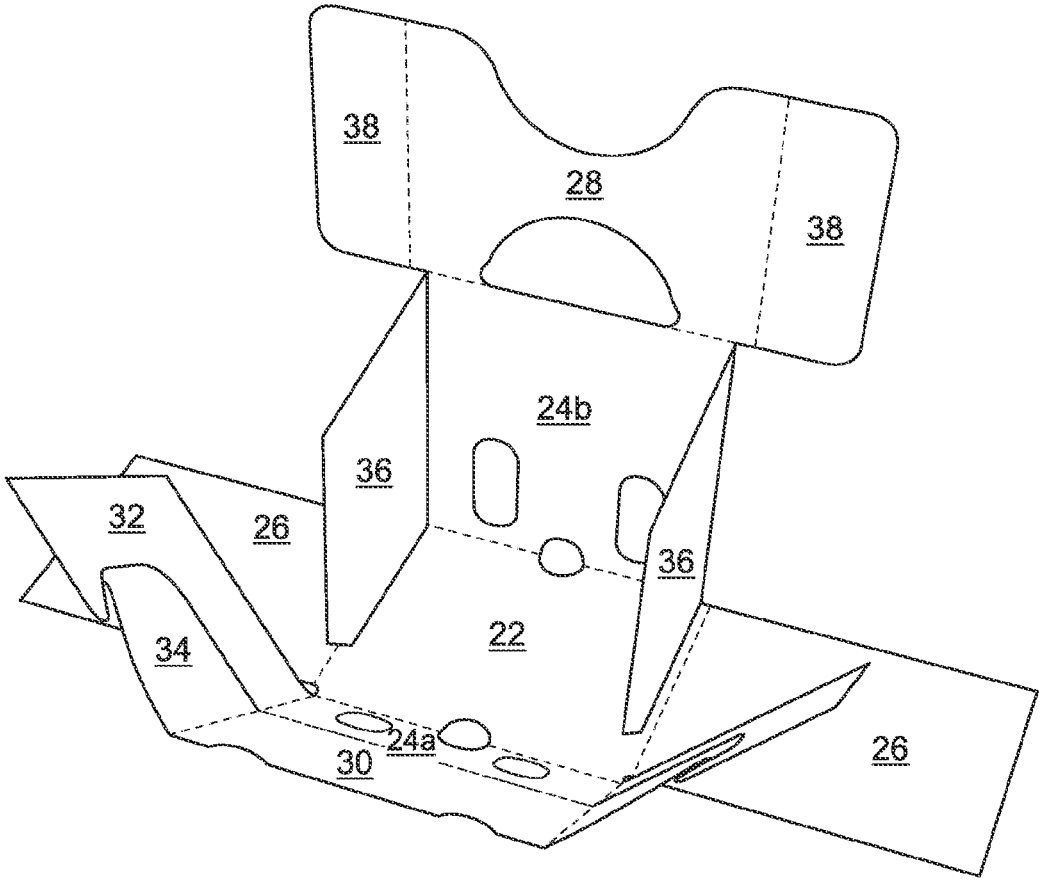
FIG. 3 is another perspective view of the partially erected blank arrangement of FIG. 1.
Figure 4:
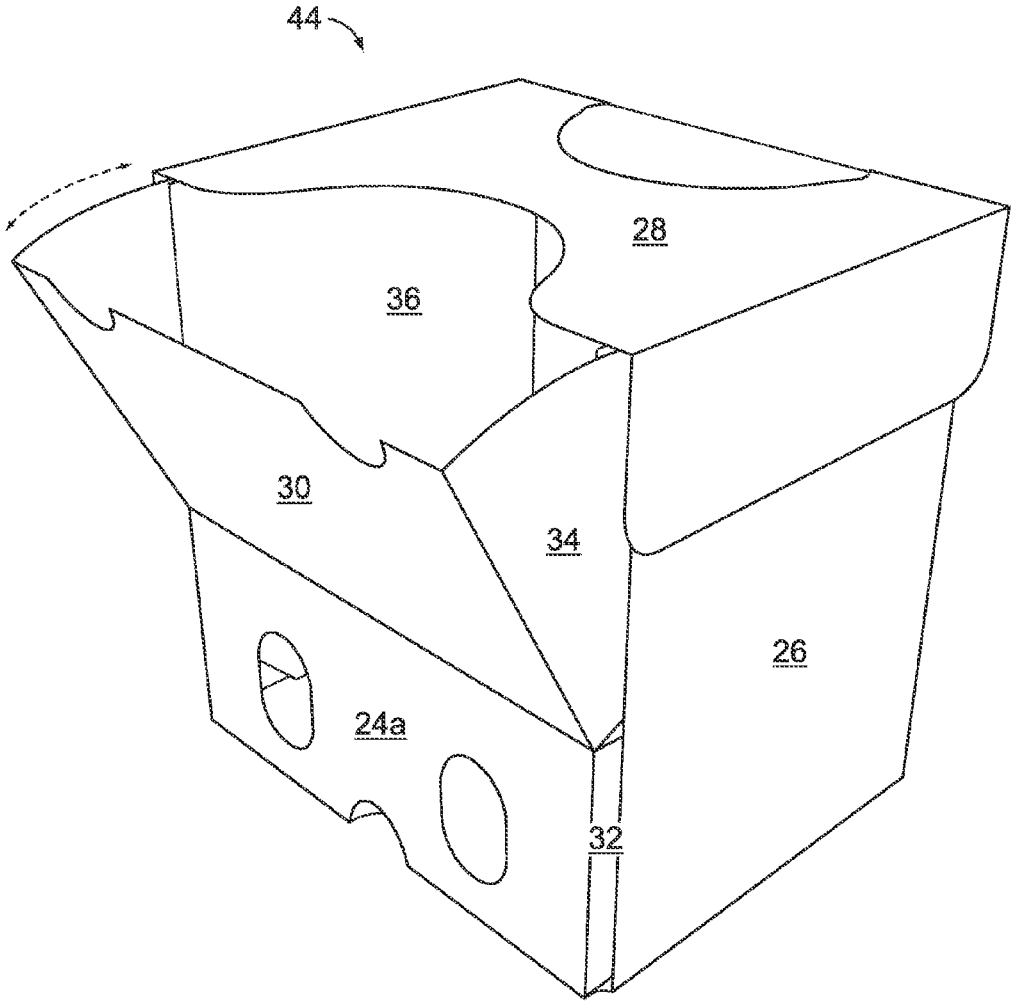
FIG. 4 is an exemplary rear perspective view of the formed showing a pivotable front panel.

With respect to FIGS. 2-3, erection of container 44 from blank 20 is depicted. Specifically, the first side panels 24 may be folded upwardly approximately 90 degrees about fold lines 21. Also, fourth side panels 36 may be folded inwardly approximately 90 degrees along fold lines 31. Similarly, third side panels 32 may be folded inwardly along fold lines 33, such that the third side panels 32 are juxtaposed to the at least a portion of the fourth side panels 36.

The tray opening area is generally formed by folding the tray panel flaps 34 inwardly approximately 90 degrees about fold lines 35. In this manner, the tray panel flaps 34 are juxtaposed a portion of the fourth side panel 36. The second side panels 26 may be folded upwardly approximately 90 degrees about fold lines 23, such that the tray panel flaps 34 and third side panels 32 arc sandwiched between the fourth side panel 36 and second side panel 26. Finally, top panel flaps 38 may be folded downwardly approximately 90 degrees about fold line 29. The top panel flaps 38 may by attached to the second side panels 26. The manner of attachment may be by any method known in the arts, such as, without limitation, glue, adhesion, braids, tacks or staples.

One possible type of product that my suitably be used with this container 44 is, with out limitation, produce such as apples or oranges. To this end, the container 44 may be used to hold a plurality or oranges (not shown) on a shelf in a store or home environment. The tray panel 34 may be opened as product is used up to provide better visibility inside the container 44. Likewise, the tray panel 34 may be opened up to provide better access to the contents in the container 44.

As noted above, the overall geometry of the various panels is not to be limited by the FIGURES. Specifically, the various side panels are depicted as being rectangular; however, some or all of the various side panels may be other geometric shape without exceeding the spirit and scope of the present invention. For example, without limitation, the first side panel 24 may be square. Likewise, the bottom panel 22 may wider or narrower as desired. It will be appreciated that the geometry of the various panels may be adjusted accordingly without exceeding the spirit and scope of the present invention. Further, vents, cut-outs, hand-holds and the like may be place as show in the FIGURES or in any other arrangement as desired. Also, the blank 20 and container 44 may be free from any such vents, cut-outs, or hand-holds if desired, all without departing the spirit and scope of the present invention.

While various embodiments of the invention have been illustrated and described, as noted above, many changes can be made without departing from the spirit and scope of the invention. Accordingly, the scope of the invention is not limited by the disclosure of such embodiments. Instead, the invention should be determined entirely by reference to the claims that follow.

What is claimed is:

1. A container comprising:

A bottom panel (22) foldably joined to a pair of second side panels (26), a front panel having an upper and lower portions wherein the upper portion defined by a tray panel (30) having a pair of tray panel flaps (34) each of which foldably joined to an opposed short sides of the tray panel (30) and the lower portion defined by a first side panel (24*a*) foldably joined to the tray panel (30), a back panel (24*b*) foldably joined to respective fourth side panels (36) and a top panel (28) being foldably joined to the back panel to form an interior space of the container, respective third side panels (32) foldably joined to the opposed first side panel (24*a*), and the respective tray panel flaps (34) and the respective third side panels (32) being held aligned to one another and sandwiched therebetween each of the respective second side panels (26) and respective fourth side panels (36), and wherein the respective tray panel flaps (34) being formed from the respective third side panels (32) such that a respective intersection of fold lines (25, 33, 35) is a center of a radius of curvature of a respective free edge of the each tray panel flaps (34) and wherein the upper portion pivots downwardly and away from the container to thereby exposing the interior of the container and to permit easy access to the container for rapid unloading from the container.

2. A container comprising:

A bottom panel (22) having a pair of first side panels (24*a*, 24*b*) and a pair of second side panels (26) foldably joined along a bottom edge to a respective edge of the bottom panel, a top panel (28) foldably joined the first side panel (24*b*) wherein the top panel includes cut outs formed therein to provide a carrier handle, a tray panel (30) foldably joined to the first side panel (24*a*) wherein the tray panel (30) having a pair of tray panel flaps (34) being pivotable with respect to the first side panel (24*a*), respective third side panels (32) foldably joined to the opposed first side panel (24*a*) and fourth side panels (36) being foldably joined to the first side panel (24*b*), wherein the respective tray panel flaps (34) and the respective third side panels (32) being held aligned to one another and sandwiched therebetween each of the respective second side panels (26) and respective fourth side panels (36) and wherein the respective tray panel flaps (34) being formed from the respective third side panels (32) such that a respective intersection of fold lines (25, 33, 35) is a center of a radius of curvature of a respective free edge of the each tray panel flaps (34).

* * * * *